US005595535A

United States Patent [19]

Wenskus

[11] Patent Number: 5,595,535

[45] Date of Patent: Jan. 21, 1997

[54] DEVICE FOR PAYING OFF COINS FROM AT LEAST A PAIR OF COIN COLLECTING TUBES

[75] Inventor: Dieter Wenskus, Dorfstrasse, Germany

[73] Assignee: National Rejectors, Inc., Buxtehude, Germany

[21] Appl. No.: 494,299

[22] Filed: Jun. 23, 1995

[30] Foreign Application Priority Data

Jun. 28, 1994 [DE] Germany ..... 44 26 585.9
Jul. 23, 1994 [DE] Germany ..... 44 26 193.4

[51] Int. Cl.[6] ..... G07D 1/00

[52] U.S. Cl. ..... 453/40; 453/49

[58] Field of Search ..... 453/19, 20, 22, 453/39, 40, 42, 49

[56] References Cited

U.S. PATENT DOCUMENTS

| | | | |
|---|---|---|---|
| 2,691,379 | 10/1954 | Foushee | 453/49 X |
| 4,202,362 | 5/1980 | Kashio | 453/20 |
| 4,276,894 | 7/1981 | Heywood | 453/40 |
| 4,313,450 | 2/1982 | Kirisawa . | |
| 4,374,529 | 2/1983 | Kobayashi et al. . | |
| 4,392,505 | 7/1983 | Maloney et al. . | |
| 4,598,724 | 7/1986 | Boland . | |
| 4,681,204 | 7/1987 | Zimmermann . | |
| 4,834,689 | 5/1989 | Levasseur . | |
| 5,021,026 | 6/1991 | Goi | 453/49 X |

FOREIGN PATENT DOCUMENTS

| | | | |
|---|---|---|---|
| 2926688 | 5/1980 | Germany . | |
| 3315982 | 11/1984 | Germany . | |
| 3810074 | 10/1989 | Germany . | |
| 4214366 | 10/1993 | Germany | 453/40 |
| 630492 | 12/1961 | Italy | 453/20 |
| 250560 | 6/1970 | U.S.S.R. | 453/49 |
| 393336 | 6/1933 | United Kingdom | 453/49 |

*Primary Examiner*—Karen B. Merritt
*Assistant Examiner*—Scott L. Lowe
*Attorney, Agent, or Firm*—Senniger, Powers, Leavitt & Roedel

[57] ABSTRACT

A device for paying off coins from two adjacent coin collecting tubes. A rotor is located below the tubes, the rotational axis of the rotor extending substantially in parallel to an axis of the tubes. An electric motor drives the rotor to rotate the rotor in either direction of rotation about the rotational axis. A pin-like ejecting element is mounted on the rotor for ejecting a lowest coin in the coin collecting tubes, the element having an idle position which does not engage the lowest coin when the rotor is rotated by the motor and having an ejecting position which engages the lowest coin when the rotor is rotated by the motor. The element is biased in the ejecting position and has a member, the rotor having a first neutral position in which the element is in its ejecting position for discharging the lowest coin and having a second neutral position in which the element is in its idle position. A motor control controls the electric motor to rotate the rotor between the first and second neutral positions. A stationary control supported adjacent the rotor selectively engages the member of the element, the stationary control including a ramp-like portion for engaging the member of the element such that, as the rotor is rotated in either direction from the second neutral position to the first neutral position, the ramp-like portion engages the member of the element to move the element to its idle position.

21 Claims, 7 Drawing Sheets

DEVICE FOR PAYING OFF COINS FROM AT LEAST A PAIR OF COIN COLLECTING TUBES

The present invention relates to a device for paying off coins from at least a pair of coin collecting tubes.

In coin-operated devices equipped with coin changers the coins to be returned as exchange money are collected in individual coin collecting tubes each accommodating coins of a certain denomination. A paying-off device removes the coins located at the lowermost end of the tubes in accordance with a pay-out command. Prior art devices use electromagnets or electric motors for performing this function to remove a lowermost coin each by means of an appropriate ejecting element to transfer the coin to a return track, for example.

German patent application P 38 10 074 discloses a pair of coin tubes which is associated to a pay-off unit comprising an electric motor operating a pair of ejecting elements each being associated to a coin using a free-wheel device. In response to the particular direction of rotation of the electric motor one of the ejecting elements associated to the coin tubes will be operated. The expenditure required for the gear means between the electric motor and ejecting elements is relatively high and needs space which is not always available in coin-operated devices.

German patent application P 42 14 366 discloses a coin vendor comprising a pair of coin collecting tubes to which a drive motor is associated which can be reversed in its direction of rotation and which motor drives through a gear means an individual cam displacing a lower coin each through an outlet slot of coin collecting tube, wherein the rotational motion of the cam is controlled depending on the direction of rotation such that the cam in performing a 360° turn displaces a coin from a first tube, while passing below the second tube. The single ejecting element or, respectively, the cam is defined by a spring biased pin which is biased into a release position and which is lifted by a control track to be moved into an ejecting position.

The known device requires for performing an ejecting operation that the electric motor rotates the cam about an angle of 360° each time, although a substantially smaller angular turn is required for performing a pay-off operation. When returning exchange money, it is generally desired that the individual coins will be returned as fast as possible.

Accordingly, it is an object of the present invention to provide a device for paying-off coins from a pair of coin collecting tubes which ensures a fast rate of returning the coins.

The object referred to is solved by the features of the invention.

According to the present invention the rotor is provided with a pair of diametrically opposed ejecting elements which are adjustable in height to occupy a release position and an ejecting position. The electric motor is operated by the control means such that the rotor performs a 180° turn each when the electric motor is actuated. Accordingly, a pair of neutral positions is defined for the ejecting elements, which positions are about substantially centrally located, i.e. each having approximately the same distance from both coin tubes. Conventional means are provided to stop the ejecting elements in the neutral position each, for example using a positioning control, or a photoelectric barrier switching off the motor when reaching the neutral position or any other means.

While performing the 180° turn just referred to an ejecting element passes below a collecting tube each, wherein the one ejecting element only operates to displace a coin, whereas the other ejecting element is in its release position. The stationary control means operating the ejecting elements are thus defined such that a first ejecting element when being rotated in either direction from one of its neutral positions will be in the ejecting position or will be moved into the ejecting position, whereas the second ejecting element occupying the other neutral position will be moved in either direction of rotation into the release position.

The device according to the invention does not need a higher expenditure in structure, space and controlling operation as compared with the conventional coin changing device, but provides for a returning rate which is twice as high.

According to a further aspect of the invention the rotor comprises a single ejecting element, which is supported by the rotor to be movable between a release position and an ejecting position and which is operated by a control means to occupy the position required. The electric motor driving the rotor is operated in an oscillating fashion such that it first performs a substantial 180° turn followed by a further 180° turn which is directed reverse. When the neutral position of the ejecting element is located on the side of the tubes where the outlet aperture for removing the coins is located, the ejecting element must first pass below the respective tube in its release position, in order to subsequently displace the coin when performing the reverse turn. The same applies for the second tube of a pair of tubes.

According to an embodiment of the present invention the rotor is defined by a disk and the ejecting elements include a pin supported in a bore of the disk, the follower means being fixed to an end of said pin through a pivot arm. The follower arm cooperates with stationary concentrically located annular grooves each having a bottom located at a different level, wherein deflecting means are provided at either side of the neutral positions for guiding the follower means into one of said both annular grooves when the ejecting elements are moved from the neutral position. The pivot arm makes it possible to pivot the follower means to enter the respective other control groove each. According to a further embodiment of the invention, the outer boundary of the inner control groove or, respectively, the inner boundary of the outer control groove include resilient portions located close to the control sections for defining a passage for the follower means such that the follower means each is automatically deflected towards the control groove which is associated to the direction of rotation. Accordingly, the follower means is prevented from entering the wrong control groove when performing the reverse direction of rotation.

The ejecting element pushes a lowermost coin each out of the coin tube onto a coin track from where it is transferred, for example, to a return channel. The walls of the coin tubes must include a recess which is oriented towards the coin track to allow the exits of the coins. According to an aspect of the invention, a locking pin is movably supported parallel to the rotational axis of the rotor below the ejecting recess of the tubes to be moved between a locking position preventing the ejection of a coin and a release position. The locking element may include a follower means alike cooperating with control grooves located on the side of the rotor facing it.

According to an alternative embodiment of the invention, the ejecting elements are defined by ejecting pins which are supported in the rotor to be adjustable in height and which are biased by a spring into the release or ejecting position, and wherein the ejecting pins include a flange cooperating with the stationary control means. Again, when making the ejecting elements this way, one must provide appropriate control means to move the pins into the release or ejecting position while the rotor performs the 180° turn. According to an embodiment of the invention, the control means include resilient, ramp-like portions located on either side of a first neutral position, which resilient portions deflect the pins through the flanges thereof into the release position when being moved from the neutral position and which resilient portions are temporarily displaced by the flange when a pin is moved into a neutral position.

Furthermore, the ejecting element can be pivotally supported about an axis perpendicular with respect to the rotor axis to be received in a recess of the rotor (release position). The tiltable ejecting element is appropriately biased by a spring either towards the neutral position or towards the ejecting position, whereas the tilting towards either position is provided by an appropriate control track or the like. Furthermore, it might be possible to provide a locking in the biased position such that the ejecting element is automatically tilted towards the other position when releasing the locking. Then the control means must be provided only at the ends of the 180° turn. Finally, any control means can be eliminated when in passing below a coin tube in a reverse direction of the ejecting direction, the rejecting element is deflected and moves from the reverse direction into the ejecting position to remove a coin.

The ejecting element pushes a lowermost coin each out of the coin tube towards a coin track to be transferred therefrom to a return channel for example. The wall of the coin tubes must include a recess oriented towards the coin track for providing the exit of the coins.

In the following, the invention will be explained in detail with a reference to the drawings.

Figure 1:
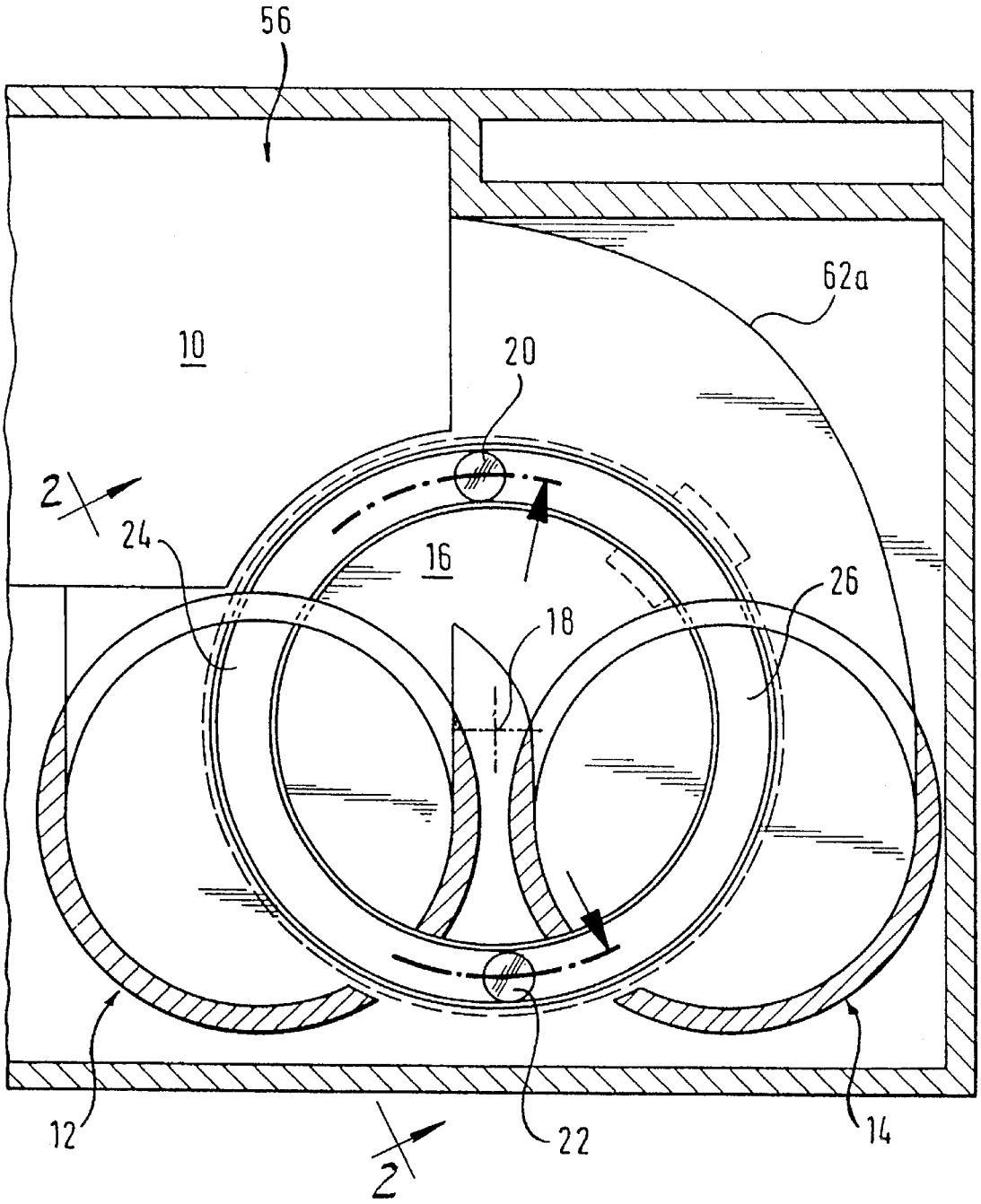
FIG. 1 shows a top view, partly a sectional view of a device according to the invention.
Figure 2:
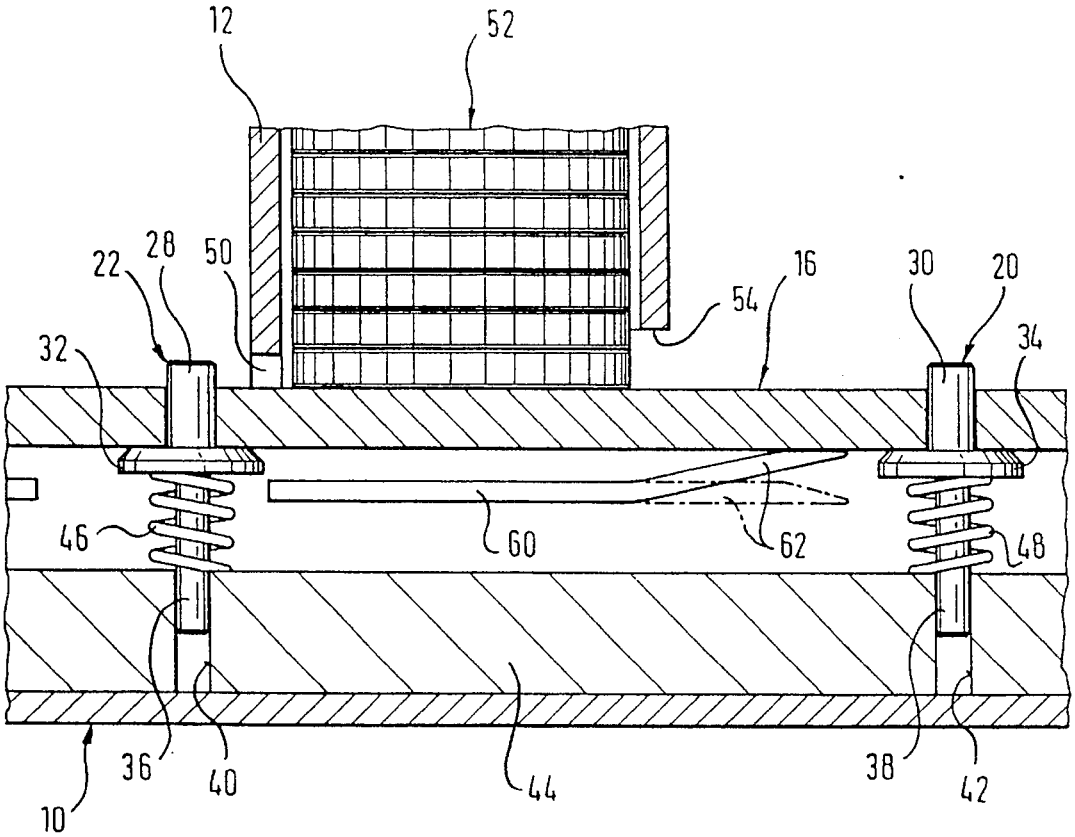
FIG. 2 is a section through the device shown in FIG. 1 along line 2—2.

FIG. 1 shows a base plate 10 including means for supporting the lower ends of coin storing and pay-off tubes 12, 14. FIG. 2 shows a section through the coin tube 12. A rotor 16 which is rotatably driven by an electromotor (not shown) about an axis 18 extending parallel with respect to the axes of the coin tubes 12, 14 includes a pair of release pins 20, 22. When the pins 20, 22 are rotated together with the rotor 16, they obviously move along a circular path approximately passing through the center of both tubes 12, 14. In the region of the tubes 12, 14 the base plate 10 is provided with arcuate slots 24, 26 such that the pins 20, 22 may displace a lowermost coin each from one of the tubes 12, 14 when the pins 20, 22 project far enough.

As shown, the removing pins 20, 22 each are positioned in a neutral or starting position, wherein the pin 20 is located in a first neutral position and the pin 22 is located in a second neutral position. The control unit (not shown) controls the electromotor (not shown) such that after a turn of 180° the pins each will be stopped at the next following neutral position.

In accordance with FIG. 2, the discharging pins 20, 22 include a discharging section 28, 30, respectively, a rotating flange 32, 34 as well as a guiding portion 36, 38 which are guided in bores 40, 42 of an axially annular flange 44 of the rotor disk 16. Springs 46, 48 are disposed in appropriate recesses of the flange 44 between the bores and the flanges 32, 34 such that the ejecting pins 20, 22 are biased towards the ejecting position which is shown in FIG. 2. When the disk 16 is moved in FIG. 2 to the right, for example, the ejecting portion 28 enters the tube 12 through a slot 50 and engages the lowermost coin each of a column 52 of coins collected in the tube 12 to displace the lowermost coin through an ejecting slot 54 outwardly towards a return chamber 56 (FIG. 1) from which the coin is fed to a return channel.

FIG. 2 further shows a guide element 60 located between the ejecting pins 20, 22 including a ramp-like resilient portion 62 adjacent the pin 20. While performing the circular path referred to above, the flange 32 engaging the rotor 16 and moving above the guide element 60 enters the ramp-like portion 62 which portion is displaced downwardly as indicated in dashed lines until reaching the position as defined by the ejecting pin 20 in FIG. 2. A nearly identical guide element, stationarily arranged alike the guide element 60 is disposed on the track along which the ejecting pins 20, 22 move during the next 180° turn. In other words, independent of the direction of the rotor 16, an ejecting pin which is located in the position of the ejecting pin 20 according to FIG. 1 will be brought into an idle position by deflecting the collar 32, 34 below the ramp-like portion 62 to be maintained below the guide element 60 until the pin reaches the opposite neutral position which is occupied by the ejecting pin 22 in FIG. 1. It should be understood that the guide element 60 only cooperates with the flange 32, 34 thus extending below the flange at one side or being bipartite including an intermediate slot for passing the guide portion 36 or 38.

Figure 3:
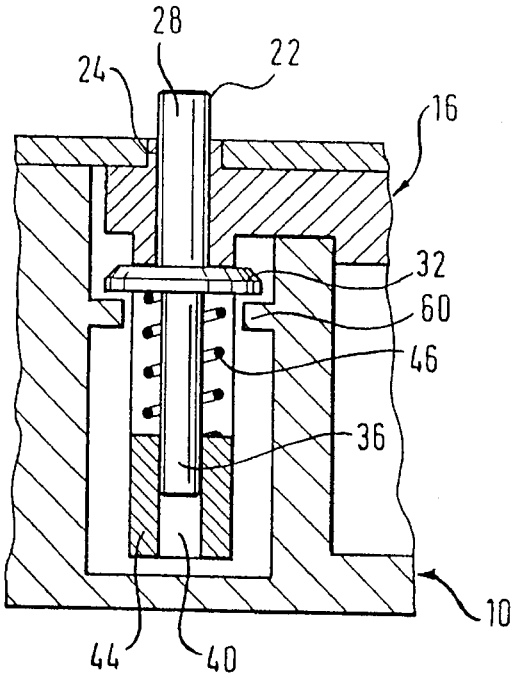
FIG. 3 shows one of the ejecting pins of FIG. 2 in the ejecting position.
Figure 4:
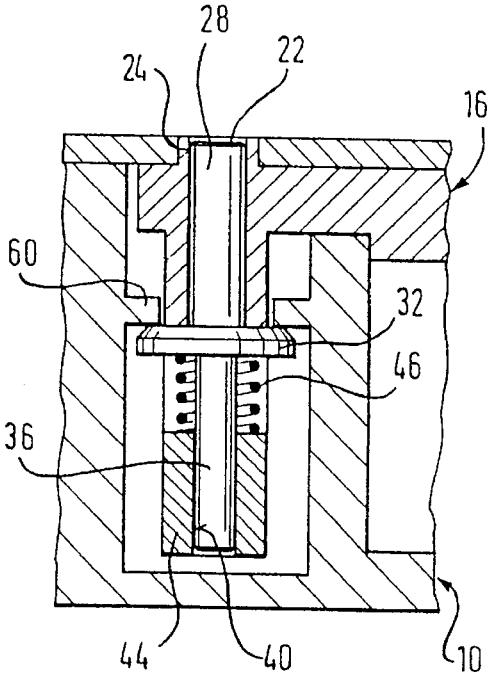
FIG. 4 shows the ejecting pin of FIG. 3 in the release position.

FIGS. 3 and 4 show the ejecting position or, respectively, the idle position of the ejecting pin 22. One notes that in FIG. 3 the flange 32 is located above the guide element 60, but in FIG. 4 is located below the guide element 60. The guide element 60 is defined by bar-like projections extending from upstanding portions of the base plate 10.

For guiding a coin from the right-hand tube 14 in FIG. 1 towards the return chamber 56, a sidewardly extending arcuate guide means **62*a*** for the coins is provided.

Figure 5:
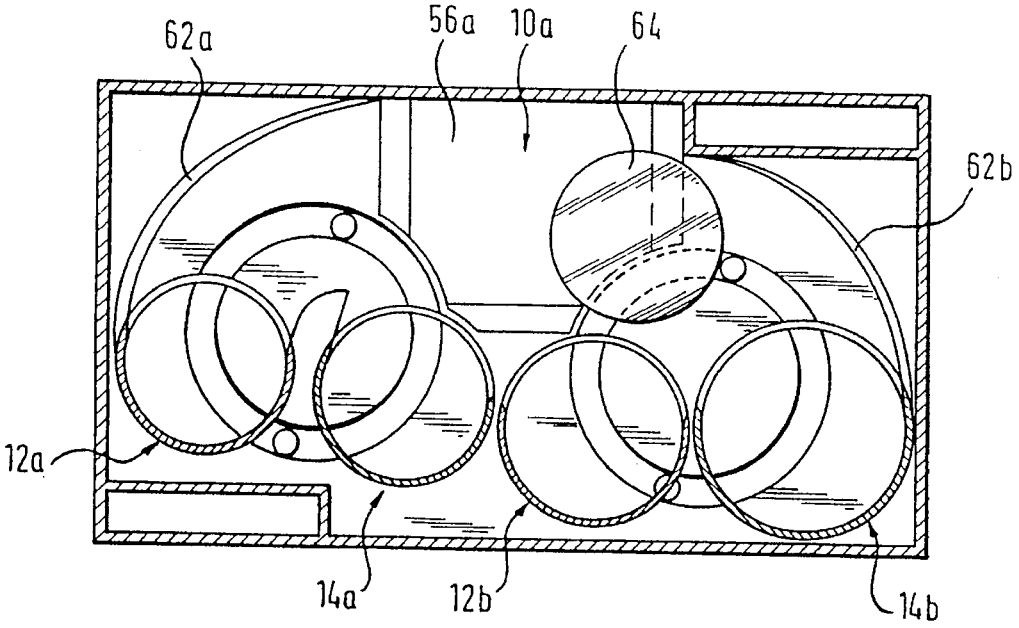
FIG. 5 is a top view, partly a sectional view of a pair of coin tubes according to the invention.

FIG. 5 shows a pair of coin tubes **12*a*, 14*a* and 12*b*, 14*b* mounted on a base plate 10*a*. Cooperating with the outer coin tubes 12*a* and 14*b*, a pair of arcuate sidewardly extending guide portions 62*a* and 62*b* are provided to feed the coins back to the returning space 56*a*. For the rest, the coin changing device is identical with the device shown and described in FIGS. 1 through 4 for a pair of tubes. FIG. 5 shows how a coin 64 is ejected by means of an ejecting pin from the righthand outer coin tube 14*b* for being fed into the return space 56*a*. The arrangement shown offers the advantage that the coins from both outer tubes 12*a*, 14*b* may be transferred from a coin track at the center towards the return space 56***a* so that an inclined track is not required.

Figure 6:
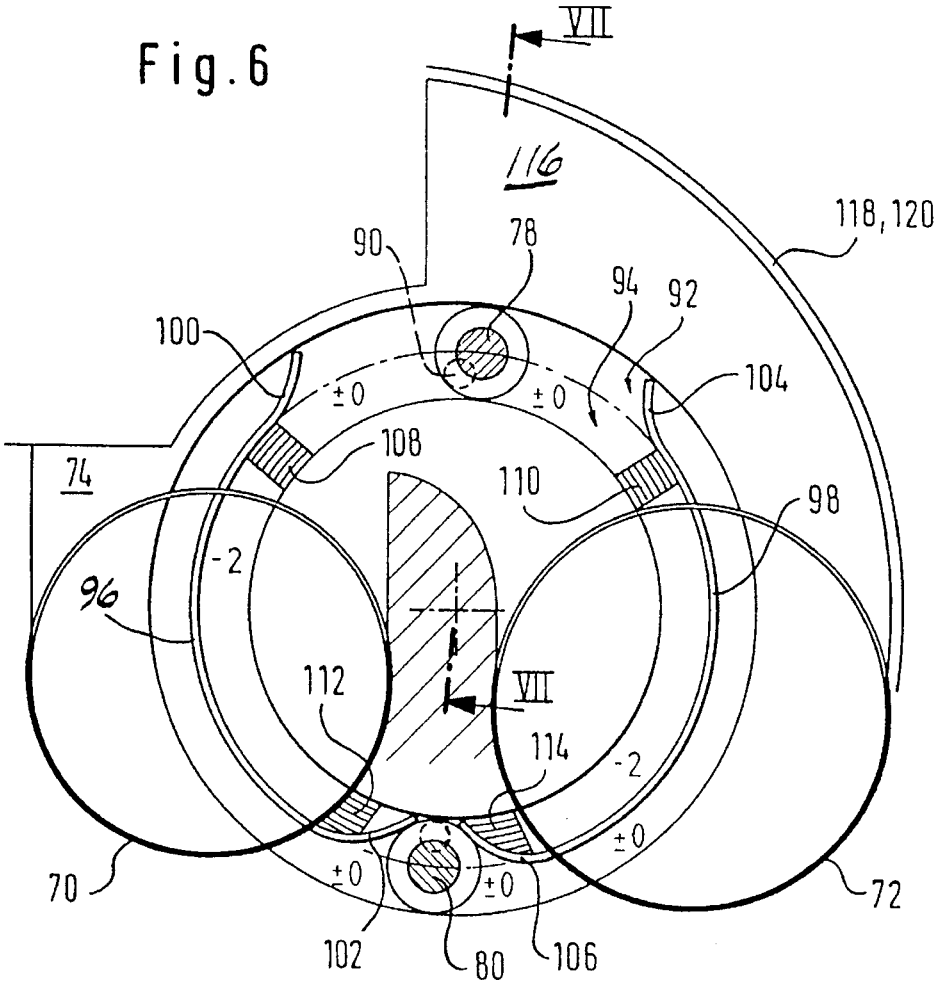
FIG. 6 is a top view, partly a sectional view of a further embodiment of the invention.
Figure 7:
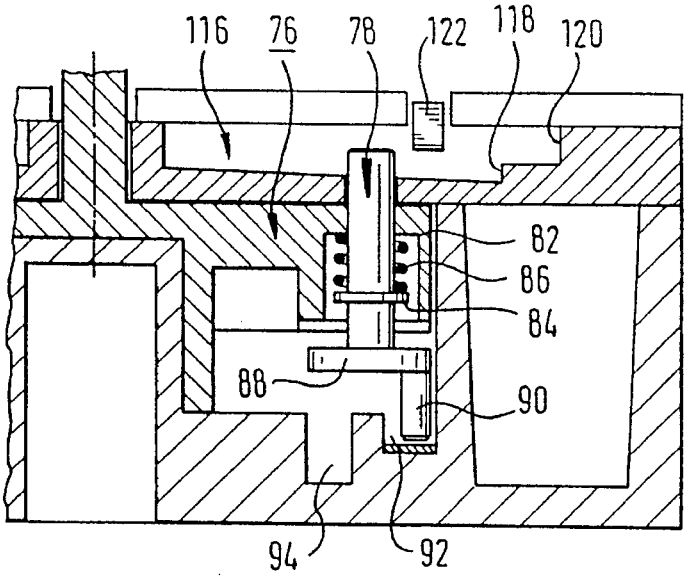
FIG. 7 is a section through the device shown in FIG. 6 along the lines 7—7.

FIGS. 6 and 7 schematically show an alternative embodiment of the ejecting device above referred to. Again, coin tubes 70, 72 are appropriately mounted on a base plate 74. A pair of ejecting pins 78, 80 is supported on a disk-shaped rotor 76. The bearing support is shown in detail in FIG. 7. The ejecting pin 78 is supported in a bore 82 of the rotor 76 to be longitudinally displaced. Below the bore 82 there is a space accommodating a flange 84 of the pin 78, a spring 86 being provided between the flange 84 and the shoulder of the recess to bias the pin 78 downwardly into the idle position. The lower end of the pin 78 is provided with an arm 88 eccentrically carrying a cam follower 90. The cam follower 90 selectively cooperates with concentrically arranged control grooves 92, 94 which are separated from each other by arcuate portions 96, 98 including resilient, outwardly or, respectively, inwardly extending portions 100, 102 and 104, 106 at the ends thereof. In the position which is occupied by the ejecting pin 80, the portions 102, 106 extend inwardly so that the cam follower 90 is displaced towards the outer groove 92 each disregarding the direction of rotation of the rotor 76. Vice versa, the cam follower of the ejecting pin 78 will be deflected from the position shown in FIG. 6 into the radially inward control groove 94 each disregarding the direction of rotation. The resilient portions 100 through 106 make it possible that the cam followers each may reach the neutral position.

The control grooves 92, 94 are arranged in different levels. In the region of the neutral position shown, the levels for the ejecting pins 78, 80 are selected such that the pins 78, 80 are positioned in the ejecting position as shown in FIG. 7. When the ejecting pin 78 moves in either one of the directions of rotation, it will be lowered along ramp-like portions 108 or 110 before reaching the tubes 70, 72 and then raised again along respective ramp-like portions 112, 114 when reaching the position of the ejecting pin 80 in FIG. 6. The outer groove 92, however, is provided with a continuous level which means that the ejecting pin 78 is always positioned in the ejecting position so that disregarding the direction of rotation of the rotor 76 a coin is removed from the respective coin tube 70 or 72. The coin moves from the tube 72 towards a coin track 116 including a stepped boundary as indicated at 118 and 120 to feed coins of different diameters. A spring element 122 shown in FIG. 7 is provided to maintain the coin in a position engaging the bottom of the coin track 116 when feeding the coin along the track 116 towards the return space not shown in FIG. 6.

The particular shape and bearing of the rotor 76 shown in FIG. 7 is not specified in detail. This can be observed from the illustration or may be implemented in a different manner.

Figure 8:
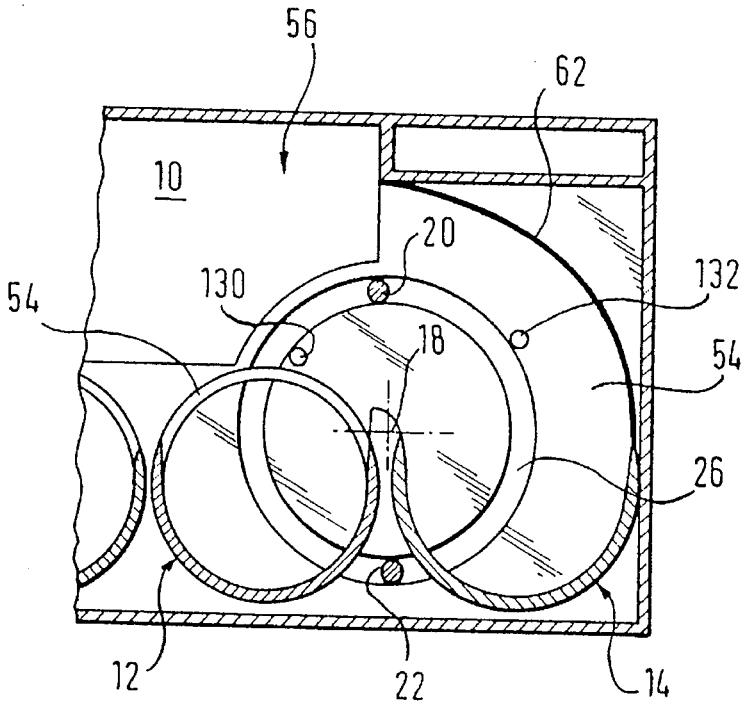
FIG. 8 is a view similar to FIG. 1 providing additional locking pins.
Figure 9:
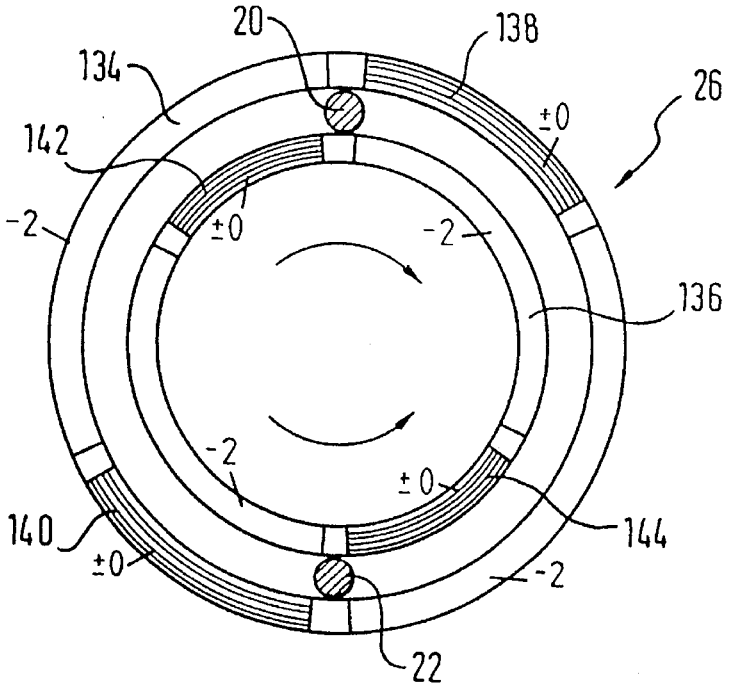
FIG. 9 is a top view of the rotor disk shown in FIG. 8.

The illustration of FIG. 8 is substantially the same as what has been shown in FIG. 1 so that identical reference numerals are used. Additionally, the base plate of the device includes a pair of locking pins 130, 132 which are supported to be displaced in height. The pins are biased by spring means (not shown) into a lower position. When occupying an upper position, the pins block the coin outlet 54 of the coin tubes 12, 14 (see also FIG. 2, but with the locking pin not shown). The locking pins thus prevent that a lowermost coin each inadvertently will be displaced from its associated coin tube.

The locking pins 130, 132 are actuated by means of an outer control track 134 and an inner control track 136 of the rotor disk 26. As shown the circular control tracks 134, 136 each include a pair of diametrically opposed control sections 138, 140 and 142, 144. When these control sections are located within the region of the locking pins 130, 132 the latter are lifted upwardly into the locking position. The remaining sections of the control tracks 134, 138, however, extend along a lowered level so that the locking pins will be lowered and thus cannot perform a locking function. The levels are indicated by ±0 and −2.

Figure 10:
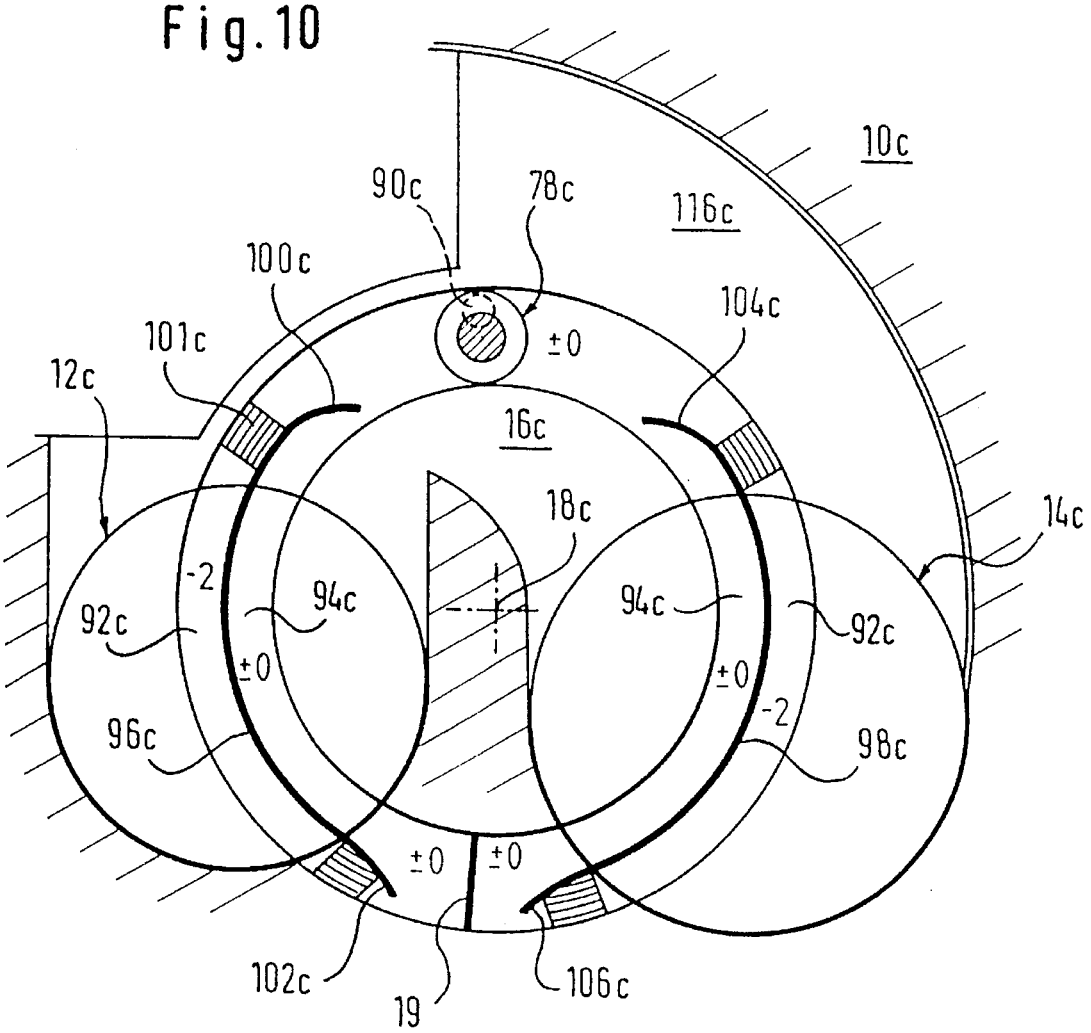
FIG. 10 is a top view of a further embodiment of the invention.

It results from the above that during a coin changing process the locking pins 130, 132 of both coin tubes 12, 14 are in a release position. Substantially, the pins are in a locking position only when the ejecting pins 20, 22 occupy its neutral position. As far as FIG. 10 shows, for components identical with FIG. 6, the same reference numerals are provided but adding a suffix c. A base plate 10*c* again supports the lower ends of coin storing and ejecting tubes 12*c*, 14*c*. A rotor 16*c* is supported in the base plate 10*c* to be rotated by an electromotor (not shown) about an axis 18*c* which extends in parallel to the axes of the coin tubes 12*c*, 14*c*. The rotor which is illustrated transparent for purpose of illustration, carries a single ejecting element 78*c*. The arrangement of the ejecting element 78*c* is similar to that shown in FIG. 7 or FIG. 3 or 4. It is thus not described in detail. The cam follower 90*c* (FIGS. 7, and 10) selectively cooperates with concentrically arranged control groove portions 92*c*, 94*c* which are formed in the base plate 10*c*. The control groove sections 92*c*, 94*c* extend about substantially 180° on either side of the neutral position of the ejecting element 78 shown in FIG. 10 up to a stop 19 which is displaced about substantially 180° with respect to the neutral position. The control groove sections 94*c* define the inner sections and the control groove sections 92*c* the outer sections. The control groove sections 92*c*, 94*c* are separated from each other by arcuate portions 96*c*, 98*c* including resilient, outwardly or inwardly extending portions 100*c*, 102*c*, 104*c*, 106*c* at the ends thereof. At either side of the neutral position of the ejecting element 78*c*, the sections 100*c*, 104*c* extend inwardly so that the cam follower 90 is deflected outwardly and is lowered via a ramp 101*c* onto a lower level (−2). In this direction the ejecting element 78*c* is such lowered to pass below a tube 12*c* or 14*c*. Towards the end of the rotational motion the ejecting element returns again to the starting level (±0), wherein the cam follower 90*c* is deflected along the portions 102*c* or 106*c* towards the inner groove sections 94*c* when being rotated reverse towards the neutral position. Accordingly, the ejecting element 78*c* occupies the ejecting position to thus eject a lowermost coin each from the respective tube 12*c*, 14*c* to be fed to a coin track 116*c* including a stepped boundary as shown in FIG. 7 at 118 and 120 to guide coins of different diameters. A spring element 122 shown in FIG. 7 provides for keeping the coin engaging the bottom of the track 116*c* when being fed along the track towards the returning space (not shown).

The rotor 16*c* of this embodiment can be formed as the rotor shown in FIGS. 3 and 4.

Figure 11:
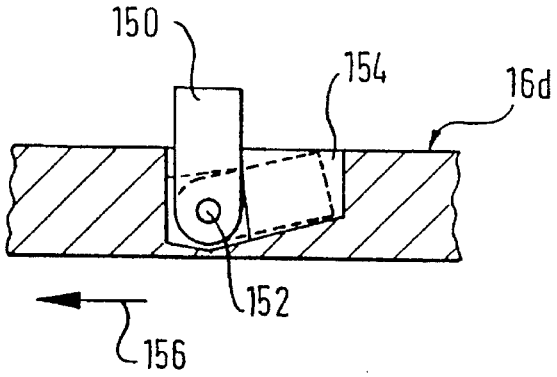
FIG. 11 shows an alternative embodiment of an ejecting element.

FIG. 11 shows part of a rotor 16d in which the ejecting element 78*c* shown in FIG. 10 is replaced by an ejecting element 150 which is pivotally supported about an axis 152 perpendicular with respect to the axis of rotation of the rotor 16*d*. The ejecting element may be thus pivoted into a recess 154 of the rotor 16*d* to be placed below the surface of the rotor 16*d*. In this position the rotor can pass below a coin tube. Preferably, the element 150 is biased to the ejecting position by a spring (not shown) engaging a shoulder of the recess.

When the rotor is moved in the direction of the arrow 156, the ejecting element 150 strikes a lowermost coin in the tube, but effects no ejecting process as the coin must be ejected from the tube in a reverse direction. After the ejecting element has passed the tube, the ejecting element 150 automatically returns to the ejecting position so that a coin may be ejected when the rotor disk 16*c* rotates in opposite direction.

Figure 12:
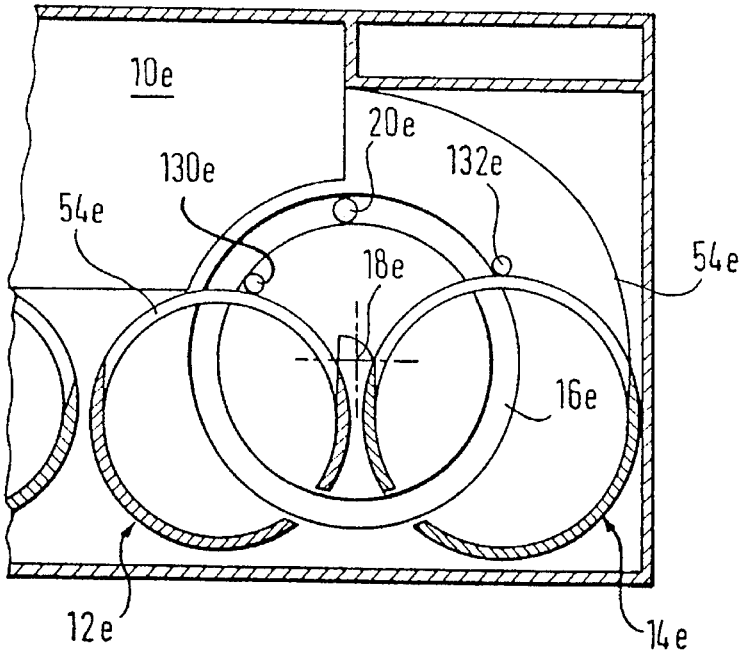
FIG. 12 is a similar illustration as FIG. 10 including a pair of locking pins and FIG. 13 is a top view of the rotor disk of FIG. 10.
Figure 13:
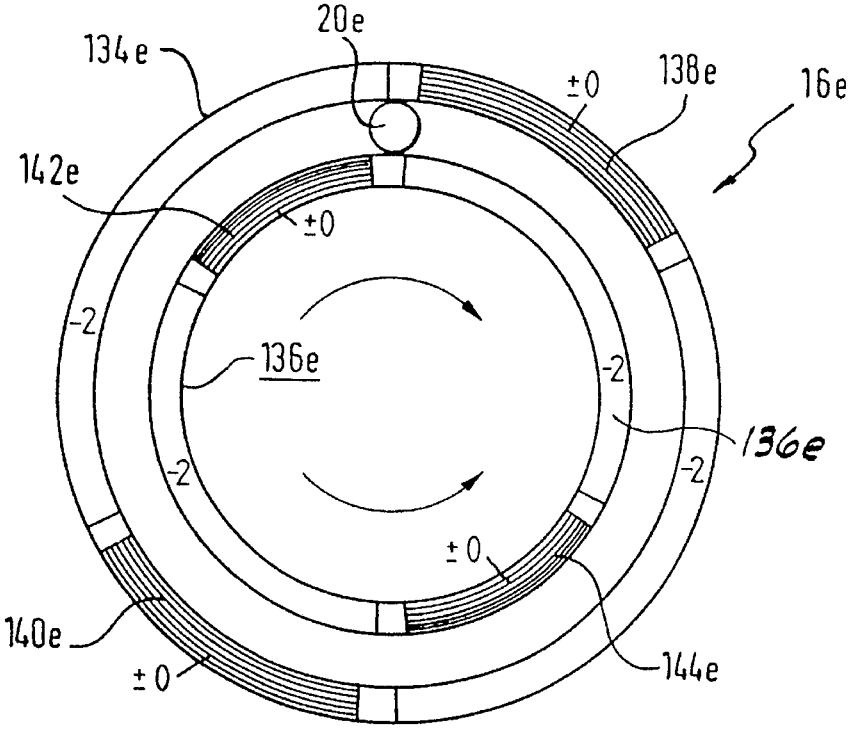

FIG. 12 shows a top view of a device similar to FIG. 1, but comprises an ejecting pin 20*e* which is shaped like the pin 20 shown in FIGS. 4 and 5. Thus identical reference numerals are used throughout. Additionally, the base plate 10*e* is provided with a pair of locking pins 130*e*, 132*e* which are supported to be displaced in height. They are biased to occupy a lower position by a spring (not shown). With the pins in an upper position they block the coin outlet 54*e* (as shown in FIG. 2) of the tubes (FIG. 2 does not show the locking pin). The locking pins thus prevent that the lowermost coin each will be inadvertently moved out from the respective coin tube.

The locking pins 130*e*, 132*e* will be actuated by means of an outer control path 134*e* and an inner control path 136*e* of the rotor disk 16*e*. The illustration shows that the circular control path 134*e* 136*e* each include a pair of diametrically opposed control sections 138*e*, 140*e* and 142*e*, 144*e*. When the control sections are located in the region of the locking pins 130*e*, 132*e*, the latter are lifted in the locking position. Contrarily, the remaining sections of the control path 134*e*, 138*e* are on a lower level resulting in a lower position of the locking pins 130*e*, 132*e* which thus do not perform a blocking function. The levels are indicated by ±0 and −2.

In accordance with the disclosure above referred to, the locking pins 130*e*, 132*e* of both coin tubes 12*e*, 14*e* are in a release position during a pay-off operation. The locking pins are substantially in a locking position only when the pay-off pin 20*e* occupies its neutral position.

I claim:

1. A device for paying off coins from at least a pair of adjacent coin collecting tubes comprising:

a rotor located below the pair of adjacent tubes, the rotational axis of said rotor being substantially parallel to the tube axes;

an electric motor driving the rotor in either direction of rotation;

control means for the electric motor to cause the motor starting from a predetermined neutral position to rotate the rotor a first 180° turn and subsequently a second 180° turn in a reverse direction;

an ejecting element mounted to the rotor to be movable between a release position and an ejecting position; and stationary control means co-operating with said ejecting element such that the ejecting element is moved by a first 180° turn of the rotor from the neutral position in either direction of rotation by the control means into one of its positions and by a second 180° turn in either direction of rotation into the other of its positions.

2. The device of claim 1, wherein the ejecting element is pivotally supported on the rotor about an axis perpendicular with respect to the rotor axis and wherein the ejecting element is received in a recess of the rotor when being in its release position, and wherein the control means selectively turns the ejecting element into the ejecting position or release position.

3. The device of claim 2, wherein in the region of a lower ejecting recess of the tubes a locking element is movably supported parallel relative to the rotational axis of the rotor to be moved between a locking position preventing ejecting of a lowermost coin and a release position, wherein the locking element includes a follower portion co-operating with a control track located on the adjacent side of the rotor concentrically with respect to the rotor axis such that in rotating the rotor the ejecting recess of the tube controlled by the ejecting element is released.

4. The device of claim 1, characterized in that the ejecting element includes a pin which is supported in the rotor to be adjustable in height and being biased by a spring into one of its positions and wherein the ejecting pin includes a flange cooperating with said stationary control means.

5. The device of claim 4, wherein the rotor has first and second neutral positions and wherein the control means include a resilient, ramp-like portion located on either side of the pin at the first neutral position of the rotor, which resilient portion deflects said pins by means of said flange into the release position when being moved from said second neutral position, and which resilient portion is temporarily displaced by said flange when the pin is moved into the first neutral position.

6. The device of claim 4, wherein the control means include a ramp-like resilient portion which resilient portion deflects said flange of the pin when being moved into the release position or which resilient portion is deflected temporarily by said flange when the pin is moved into the ejecting position.

7. The device of claim 1, wherein the rotor is defined by a disk and the ejecting element includes a pin supported in a bore of the disk, further comprising follower means being fixed to an end of said pin through a pivot arm, wherein the control means includes a pair of stationary concentrically located annular grooves each having a bottom located at a different level, one of the annular grooves maintaining the pin in an ejecting position and the other annular groove maintaining the pin in a neutral position, and further comprising deflecting means guiding the follower means into one of said annular grooves in response to the direction of rotation.

8. The device of claim 7, wherein the outer boundary of the inner control groove section and the inner boundary of the outer control groove section include resilient means located adjacent opposite sides of the tubes for defining a passage for the follower means such that the follower means is deflected towards the control groove section associated with a direction of rotation.

9. The device of claim 7, wherein the deflecting means include control sections spaced apart in the peripheral direction of the control grooves, wherein said follower means are located between said control sections, and wherein the follower means are radially inwardly or outwardly deflected depending on the direction of rotation to engage one of said control grooves.

10. The device of claim 9, wherein the outer boundary of the inner control groove section and the inner boundary of the outer control groove section include resilient means located adjacent the neutral positions for defining a passage for the follower means such that the follower means is deflected towards the control groove which is associated with a direction of rotation.

11. A device for paying off coins from two adjacent coin collecting tubes comprising:

a rotor located below the tubes, the rotational axis of said rotor extending substantially in parallel to an axis of the tubes;

an electric motor driving the rotor to rotate the rotor in either direction of rotation about the rotational axis;

a pin-like ejecting element being mounted on the rotor for ejecting a lowest coin in the coin collecting tubes, said element having an idle position which does not engage the lowest coin when the rotor is rotated by the motor and having an ejecting position which engages the lowest coin when the rotor is rotated by the motor, said element being biased in the ejecting position and having a member, said rotor having a first neutral position in which the element is in its ejecting position for discharging the lowest coin and having a second neutral position in which the element is in its idle position;

control means controlling the electric motor to rotate the rotor between the first and second neutral positions; and stationary control means supported adjacent the rotor to selectively engage the member of the element, said stationary control means including a ramp-like portion for engaging the member of the element such that as the rotor is rotated in either direction from the second neutral position to the first neutral position the ramp-like portion engages the member of the element to move the element to its idle position wherein rotation of the rotor from the first neutral position to the second neutral position causes the element to eject a coin independent of the direction of rotation of the rotor and rotation of the rotor from the second neutral position to the first neutral position causes the element to be brought into its idle position independent of the direction of rotation of the rotor.

12. The device of claim 11 wherein the ramp-like portion of the stationary control means is a resilient portion for engaging the member of the element in the ejecting position such that as the rotor is rotated in either direction from the first neutral position to the second neutral position the resilient portion is temporarily deformed by the member of the element so that the element maintains its ejecting position during rotation to permit the element to engage one of the lowest coins wherein rotation of the rotor from the first neutral position to the second neutral position causes the member of the element to temporarily deform the resilient member and rotation of the rotor from the second neutral position to the first neutral position causes the member of the element to engage the ramp-like portion and move the element to its idle position.

13. The device of claim 11 wherein the member is a collar.

14. The device of claim 11 wherein the element comprises a pin supported for movement in a bore of the rotor, wherein the member comprises a follower being connected to the pin through a crank arm, further comprising a first stationary concentric annular groove engaging the follower and having a bottom portion maintaining the pin in its idle position, and a second stationary concentric annular groove engaging the follower and having bottom portion maintaining the pin in its ejecting position, and wherein the ramp-like portion guides the follower into one of the annular grooves as the rotor is moved between the first and second neutral positions.

15. A device for paying off coins from two adjacent coin collecting tubes comprising:

a rotor located below the tubes, the rotational axis of said rotor extending substantially in parallel to an axis of the tubes;

an electric motor driving the rotor to rotate the rotor in either direction of rotation about the rotational axis;

a pin-like ejecting element being mounted on the rotor for ejecting a lowest coin in the coin collecting tubes, said element having an idle position which does not engage the lowest coin when the rotor is rotated by the motor and having an ejecting position which engages the lowest coin when the rotor is rotated by the motor, said element being biased in the idle position and having a member, said rotor having a first neutral position in which the element is in its ejecting position for discharging the lowest coin and having a second neutral position in which the element is in its idle position;

control means controlling the electric motor to rotate the rotor between the first and second neutral positions; and stationary control means supported adjacent the rotor to selectively engage the member of the element, said stationary control means including a ramp-like portion for engaging the member of the element such that as the rotor is rotated in either direction from the first neutral position to the second neutral position the ramp-like portion engages the member of the element to move the element to its ejecting position wherein rotation of the rotor from the first neutral position to the second neutral position causes the element to be brought into the eject position to eject a coin independent of the direction of rotation of the rotor and rotation of the rotor from the second neutral position to the first neutral position causes the element to remain in its idle position independent of the direction of rotation of the rotor.

16. The device of claim 15 wherein the ramp-like portion of the stationary control means is a resilient portion for engaging the member of the element in its idle position such that as the rotor is rotated in either direction from the second neutral position to the first neutral position the resilient portion is temporarily deformed by the member of the element so that the element maintains its idle position during rotation wherein rotation of the rotor from the second neutral position to the first neutral position causes the member of the element to temporarily deform the resilient member and rotation of the rotor from the first neutral position to the second neutral position causes the member of the element to engage the ramp-like portion and move the element to its ejecting position.

17. The device of claim 15 wherein the member is a collar.

18. The device of claim 15 wherein the element comprises a pin supported for movement in a bore of the rotor, wherein the member comprises a follower being connected to the pin through a crank arm, further comprising a first stationary concentric annular groove engaging the follower and having a bottom portion maintaining the pin in its idle position, and a second stationary concentric annular groove engaging the follower and having a bottom portion maintaining the pin in its ejecting position, and wherein the ramp-like portion guides the follower into one of the annular grooves as the rotor is moved between the first and second neutral positions.

19. A device for paying off coins from two adjacent coin collecting tubes comprising:

a rotor located below the tubes, the rotational axis of said rotor extending substantially in parallel to an axis of the tubes;

an electric motor driving the rotor to rotate the rotor in either direction of rotation about the rotational axis;

a vertically displaceably supported ejecting element being mounted on the rotor for ejecting a lowest coin in the coin collecting tubes, said element having an idle position which does not engage the lowest coin when the rotor is rotated by the motor and having an ejecting position which engages the lowest coin when the rotor is rotated by the motor, said element being biased in the ejecting position and having a follower, said rotor having a first neutral position in which the element is in its ejecting position and having a second neutral position in which the element is in its idle position;

control means controlling the electric motor to rotate the rotor between the first and second neutral positions and stationary control means supported adjacent the rotor to selectively engage the follower of the element, said stationary control means engaging the follower of the element such that as the rotor is rotated in either direction from the second neutral position to the first neutral position the stationary control means engages the follower of the element to move the element to its idle position wherein rotation of the rotor from the first neutral position to the second neutral position causes the element to eject a coin independent of the direction of rotation of the rotor and rotation of the rotor from the second neutral position to the first neutral position causes the element to be brought into its idle position independent of the direction of rotation of the rotor.

20. The device of claim 19 wherein the control means controls the motor to rotate the rotor in one direction from the first neutral position to the second neutral position and then to rotate the rotor in the other direction from the second neutral position to the first neutral position whereby the stationary control means selectively flaps the ejecting element in the ejecting and idling positions, respectively.

21. A device for paying off coins from two adjacent coin collecting tubes comprising:

a rotor located below the tubes, the rotational axis of said rotor extending substantially in parallel to an axis of the tubes;

an electric motor driving the rotor to rotate the rotor in either direction of rotation about the rotational axis;

two diametrically located pin-like ejecting elements being mounted on the rotor for ejecting a lowest coin in the coin collecting tubes, said elements having an idle position which does not engage the lowest coin when the rotor is rotated by the motor and having an ejecting position which engages the lowest coin when the rotor is rotated by the motor, each said element being biased in the ejecting position and having a member, said rotor having neutral positions in which one of the elements is in its ejecting position for discharging the lowest coin and in which the other element is in a its idle position;

control means controlling the electric motor to rotate the rotor from one neutral position to the next neutral position; and stationary control means supported adjacent the rotor to selectively engage the members of the elements, said stationary control means including a ramp-like portion for engaging the member of one of the elements such that as the rotor is rotated in either direction from one neutral position to the next neutral position the ramp-like portion engages the member of said one element to move said one element to its idle position wherein rotation of the rotor from one neutral position to the next neutral position causes the other of said elements to eject a coin independent of the direction of rotation of the rotor and causes said one element to be brought into its idle position independent of the direction of rotation of the rotor.

* * * * *